United States Patent [19]

Mueller

[11] Patent Number: 4,492,942

[45] Date of Patent: Jan. 8, 1985

[54] ELECTRO-MAGNETIC RELAY

[75] Inventor: Erwin Mueller, Munich, Fed. Rep. of Germany

[73] Assignee: Siemens Aktiengesellschaft, Berlin & Munich, Fed. Rep. of Germany

[21] Appl. No.: 475,225

[22] Filed: Mar. 14, 1983

[30] Foreign Application Priority Data

Dec. 22, 1982 [DE] Fed. Rep. of Germany ..... 3213759

[51] Int. Cl.[3] ..... H01H 67/02

[52] U.S. Cl. ..... 335/202; 335/276; 335/270

[58] Field of Search ..... 335/80, 81, 124, 125, 335/128, 187, 202, 203, 270, 271, 272, 276, 279

[56] References Cited

U.S. PATENT DOCUMENTS

| | | | |
|---|---|---|---|
| 3,079,478 | 2/1963 | Pahud | 335/203 |
| 3,163,805 | 12/1964 | Vash et al. | 335/276 |
| 3,165,676 | 1/1965 | O'Brien | 335/276 |
| 3,517,359 | 6/1970 | Trbovich et al. | 335/279 |
| 3,588,769 | 6/1971 | Buckwalter | 335/279 |
| 3,946,347 | 3/1976 | Sauer | 335/202 |
| 4,058,783 | 11/1977 | Reuting | 335/276 |
| 4,091,346 | 5/1978 | Nishimura et al. | 335/202 |
| 4,339,735 | 7/1982 | Ono et al. | 335/276 |

*Primary Examiner*—E. A. Goldberg
*Assistant Examiner*—George Andrews
*Attorney, Agent, or Firm*—Hill, Van Santen, Steadman & Simpson

[57] ABSTRACT

The relay exhibits a coil body on whose one flange an armature retaining element is integrated over elastic stays. A bar-shaped armature is secured in the frame-like armature retaining element, whereby the elastic flexural stays serve as a bearing for the armature. Additional fastening parts for the armature are thereby eliminated. A friction-free armature seating also thereby derives.

13 Claims, 6 Drawing Figures

ELECTRO-MAGNETIC RELAY

CROSS-REFERENCE TO RELATED APPLICATION

Application, Hill Firm Case No. P-82,2108, inventor Erwin Mueller, has subject matter related to the instant application.

BACKGROUND OF THE INVENTION

The invention relates to an electro-magnetic relay having an elongated armature which extends essentially parallel to the axis of the excitation coil and which is pivotably seated with one end at a flange of the coil body, particularly according to German patent application P 31 32 239.5, corresponding to U.S. Ser. No. 401,236, incorporated herein by reference.

The relay according to the aforementioned reference has the advantage that, as a result of directly fastening the springy contact arms in the insulating carrier of the armature, the armature motion is directly transmitted to the springy contact arms so that no actuation slide is required. Due to the connection of the movable springy contact arms to the insulating carrier, thus any and all friction between the armature and movable contact spring arm which would otherwise be caused by a standard actuation slide is avoided. However, all friction is not avoided in the sample embodiments of the aforementioned reference since the knife-edge bearings and trunion mountings of the armature disclosed there cause admittedly slight but not negligible friction.

SUMMARY OF THE INVENTION

An object of the invention is to improve a relay of the type initially cited, particularly according to the aforementioned reference, such that the armature is seated practically friction-free with a few parts which are easy to assemble.

This object is inventively achieved in that the seated end of the armature is secured in an armature retaining element which is integrated to the coil body over one or more elastic stays or support arms.

By means of integrating the armature retaining element in the synthetic coil body, it becomes possible to obtain a friction-free armature seating and to eliminate additional parts. Moreover, a summation or accumulation of tolerances is prevented since no separately manufactured transition elements are present between the armature and the coil body and, normally, the iron parts of the magnetic circuit are seated at the coil body.

The armature-retaining element is expediently designed in frame-like fashion so that the armature is held by means of plug-in fastening in the cut-out of the frame. In this case, the armature is inserted in a longitudinal direction in the recess of the armature retaining element and is held by means of a press fit or by means of a latch connection as well. Such a latch connection can, for example, be achieved by means of cooperating notches and projections at the armature on the one hand and at the armature retaining element on the other hand.

In another embodiment, the armature-retaining element can also exhibit a U-shaped recess in which the armature is secured by plugging and, if need by, by engagement as well. In case it is necessary to insulate the end of the armature from metallic parts of the magnetic circuit, for instance from a metallic relay cover, then the armature retaining element can exhibit a closed back wall as an extension of the longitudinal axis of the armature.

The elastic stay which respectively connects the armature retaining element to the coil body expediently exhibits a rectangular cross-section at its narrowest location, the narrow side of said rectangular cross-section proceeding in the direction of the rotational axis of the armature. This elastic stay or, respectively these elastic stays, in a preferred embodiment, are formed by two oppositely rounded notches between the coil flange and the armature retaining element.

In a preferred embodiment, the armature is disposed in an axial opening of the coil body, whereby the armature retaining element is integrated on the one coil flange over two flexural stays disposed at both sides of the armature. In another embodiment, the armature can also be disposed at the side of the coil and be secured in an armature retaining element correspondingly integrated laterally on a coil flange. Corresponding to the aforementioned reference, the armature retaining element can also additionally carry one or more elongated contact elements which are secured parallel to the armature and which are moved in common with said armature.

DESCRIPTION OF THE PREFERRED EMBODIMENTS

Figure 1:
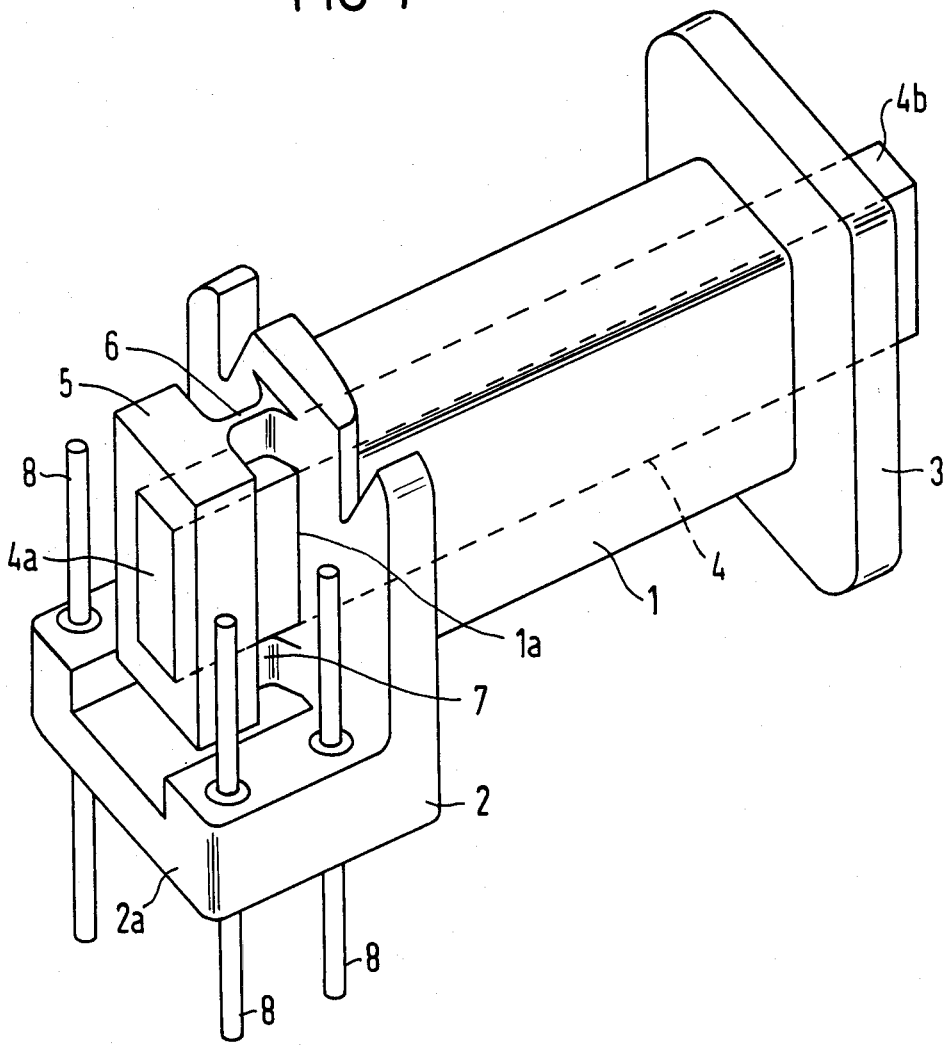
FIG. 1 illustrates a coil body with an armature retaining element for an inventive relay.

The coil body with armature illustrated in a perspective view in FIG. 1 can be employed in a relay, for example in a relay according to the aforementioned reference. This coil body 1, which is shown without a winding, exhibits two coil flanges 2 and 3, whereby the one end 4*a* of an elongated, bar-shaped armature 4 is seated in the area of the coil flange 2 so that it extends through an opening 1*a* of the coil body 1 in the axial direction of said coil body 1 and so that its free end 4*b* can execute switch motions between reciprocal poles (not illustrated).

A frame-like armature retaining element 5 which is integrated on the coil body flange 2 over elastic stays or supporting arms 6 and 7 serves for seating the armature. The armature is thereby held in the frame-like armature retaining element by means of a press fit, whereas the flexural stays 6 formed by oppositely rounded notches form the rotational axis of the armature at their respective narrowest location.

The flange 2 of the coil body forms a projection 2*a* below the armature retaining element 5 which, for example, carries coil connection pins 8. The overall coil body with armature can be put in place on a relay base body (not illustrated) as disclosed, for example, as in the aforementioned reference. Sets of contact spring arms actuatable by the armature can either be laterally attached to the coil body or can be secured in the base body. As provided in the aforementioned reference, the movable contact spring arms can thereby also be secured in a correspondingly designed armature retaining element (see also FIG. 6).

Figure 2:
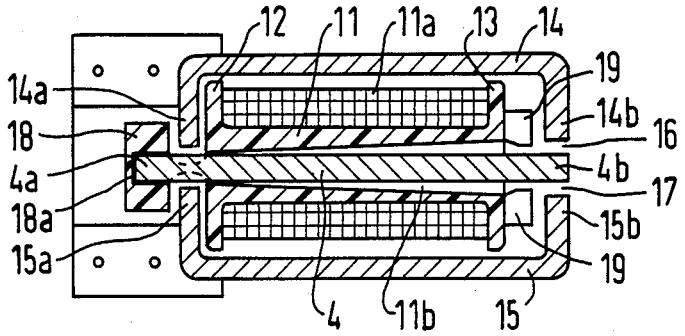
FIG. 2 shows a modified embodiment of the coil body in a side view.

A somewhat partially modified embodiment of a coil body with armature is shown in section seen from the top in FIG. 2. The coil body 11 with flanges 12 and 13 carries a winding 11*a*, whereas the bar-shaped armature 4 is disposed at its inside. Two bent shackles or conductive strips 14 and 15 thereby serve to close the magnetic circuit, the ends 14*a* and 15*a* of said shackles 14 and 15 approaching the seated armature end 4*a* and their ends 14*b* and 15*b* forming respective working air gaps 16 or, respectively 17, relative to the armature end 4*b*. The system can be polarized by means of a permanent magnet (not illustrated), so that, depending upon excitation, the armature is attracted to the one or to the other magnetic circuit shackle 14 or respectively 15.

The armature retaining element 18 is designed similar to the armature retaining element 5 in FIG. 1. In comparison to this, however, it exhibits a closed back wall 18*a* so that the inserted armature end 4*a* is insulated.

In this case, the coil tube or opening 11*b* is conically designed, i.e. the opening in the area of the coil flange 12 in the proximity of the armature seating is narrow, whereas it is wider in the area of the coil flange 13 in the proximity of the free armature end. An unimpeded switch motion of the armature is therefore possible, whereas, on the other hand, the space not required for the switch motion is filled by the synthetic of the coil body and lends the coil body greater stability. This has the advantage in the manufacture of the coil body that the core of the injection molding die can be more easily withdrawn due to the conical form. In the area of the coil flange 13, the coil body according to FIG. 2 further exhibits two stop noses 19 by means of which the armature stroke can be exactly limited.

Figure 3:
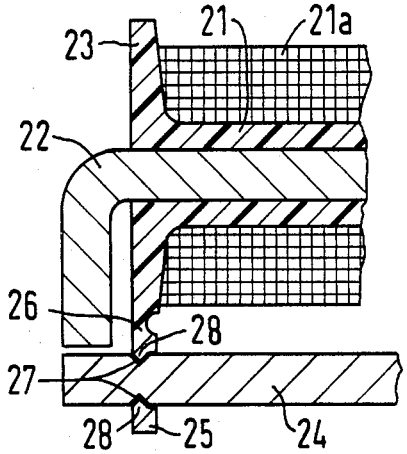
FIGS. 3 through 5 illustrate further modifications of the coil body and of the armature in detail views.

In a detailed illustration, FIG. 3 shows another embodiment of the coil body. The inside of the coil body 21 with winding 21*a* contains a yoke 22 which is angled off at the coil flange 23. In this case, the bar-shaped armature 24 is disposed parallel to the coil axis and next to the coil and is secured in an armature retaining element 25 integrated on the coil flange 23. This armature retaining element 25 is also connected to the coil body 21 over one or more flexural stays or support arms 26 and allows a switch motion of the armature 24. For mounting purposes, the armature exhibits one or more notches 27 in which catch noses 28 of the armature retaining element 25 engage.

Figure 4:
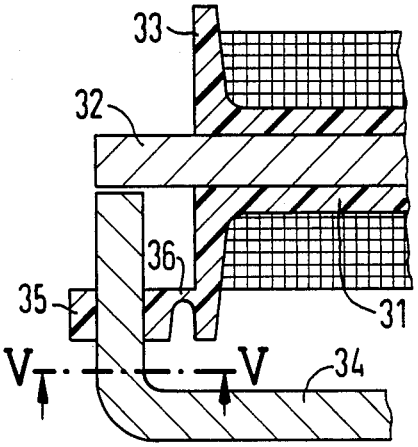

The embodiment according to FIG. 4 is largely identical to that of FIG. 3. There, the coil body 31 carries an elongated, straight-line yoke 32 inside which projects beyond the coil flange 33 in an axial direction and to which an armature 34 designed in angled-off fashion is coupled. The armature 34 is secured in an armature retaining element 35 which is connected to the coil flange 33 over a flexural stay or support 36.

Figure 5:
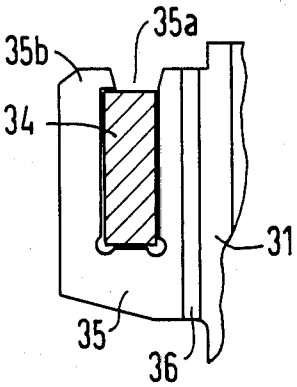

The fastening of the armature 34 in the armature retaining element 35 can, for example, be provided in accordance with FIG. 5. In this case, the armature retaining element exhibits a U-shaped opening 35*a* in which the armature 34 can be inserted from above. It is held in the armature retaining element 35 by means of the snap-in tooth 35*b*.

Figure 6:
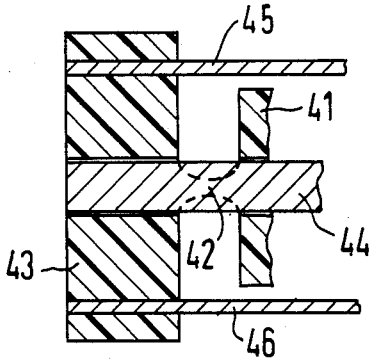
FIG. 6 shows a further modified embodiment of the armature retaining element.

In a detailed illustration, FIG. 6 shows yet another modified embodiment of the armature retaining element. An armature retaining element 43 is integrated over flexural stays or support arms 42 on the merely schematically illustrated coil body 41, said armature retaining element 43 carrying not only an armature 44, but also movable contact spring arms 45 and 46 according to the aforementioned reference at lateral projections as well. Moreover, the construction of the relay is also thereby subject to modification in accordance with the preceding Figures or according to the aforementioned reference.

Although various changes and modifications might be proposed by those skilled in the art, it will be understood that I wish to include within the claims of the patent warranted hereon all such changes and modifications as reasonably come within my contribution to the art.

I claim as my invention:

1. An electro-magnetic relay, comprising: an elongated armature which extends substantially parallel to an axis of an excitation coil having a coil body and which is pivotably secured at one end to a flange of the coil body; the secured end of the armature being attached to an armature retaining element connected to the coil body over at least one elastic stay or support arm; and the armature retaining element being designed in frame-like fashion and holds the armature with a plug-in fastening system.

2. An electro-magnetic relay, comprising: an elongated armature which extends substantially parallel to an axis of an excitation coil having a coil body and which is pivotably secured at one end to a flange of the coil body; the secured end of the armature being attached to an armature retaining element connected to the coil body over at least one elastic stay or support arm; and the armature retaining element having a U-shaped recess in which the armature is latchably secured.

3. An electro-magnetic relay, comprising: an elongated armature which extends substantially parallel to an axis of an excitation coil having a coil body and which is pivotably secured at one end to a flange of the coil body; the secured end of the armature being attached to an armature retaining element connected to the coil body over at least one elastic stay or support arm; and the elastic stay being formed by an arm formed by two oppositely rounded notches in elastic material between the coil flange and the armature retaining element.

4. An electro-magnetic relay, comprising: an elongated armature which extends substantially parallel to an axis of an excitation coil having a coil body and which is pivotably secured at one end to a flange of the coil body; the secured end of the armature being attached to an armature retaining element connected to the coil body over at least one elastic stay or support arm; the elastic stay being formed by an arm formed by two oppositely rounded notches in elastic material between the coil flange and the armature retaining element; and an opening being provided in the coil body which accepts the armature, said opening being constricted in a direction toward the coil flange carrying the armature retaining element.

5. An electro-magnetic relay, comprising: an elongated armature which extends substantially parallel to an axis of an excitation coil having a coil body and which is pivotably secured at one end to a flange of the coil body; the secured end of the armature being attached to an armature retaining element connected to the coil body over at least one elastic stay or support arm; and the retaining element, coil flange, and stay all being integral and of the same material.

6. A relay according to claim 5 wherein the armature retaining element has a closed back wall abutting an end of the armature.

7. A relay according to claim 5 wherein the elastic stay has a rectangular cross-section at its narrowest location, a narrow side of said rectangular cross-section facing in a direction of a rotational axis of the armature.

8. A relay according to claim 5 wherein two elastic stays extend from the armature retaining element to the coil body in a direction of a longitudinal axis of the armature on opposite sides of the armature.

9. A relay according to claim 5 wherein the armature is disposed at a side of the coil body and is secured in the armature retaining element laterally integrated and attached via the stay on the coil flange.

10. A relay according to claim 5 wherein at least one elongated contact element is secured in the armature retaining element parallel to the armature.

11. An electro-magnetic relay, comprising: an excitation coil having a coil body with a flange; an armature having an armature retaining element attached to the flange via integral first and second elastic stays or supporting arms on respective opposite sides of a longitudinal axis of the armature; the armature extending along a winding axis of the coil and through an inner opening within the coil body; the elastic stays permitting a rotation of the armature and armature retaining element about an axis perpendicular to the coil winding axis; and the stays extending between the armature retaining element and flange in a direction of the longitudinal axis of the armature, and wherein the stays bend to permit said rotation.

12. An electro-magnetic relay, comprising: an excitation coil with a coil body having a flange; an armature retaining element connecting to the flange via a flexural stay, said armature retaining element being positioned so as to permit an armature attached to the armature retaining element to run along a side of the coil along a direction of a winding axis thereof; and a magnetic yoke passing through a center of the coil having an end in proximity to the armature.

13. The relay of claim 12 wherein the armature retaining element is an integral part of the coil flange and the flexural stay comprises a portion of the integral material removed so as to provide a bending or flexing area.

* * * * *